US007344447B2

(12) United States Patent
Chang

(10) Patent No.: US 7,344,447 B2
(45) Date of Patent: Mar. 18, 2008

(54) HANDLE STRUCTURE FOR BALL STRIKING EQUIPMENTS

(75) Inventor: Chun-Fu Chang, Taichung Hsien (TW)

(73) Assignee: Ming Hsing Leather Co., Ltd., Taichung Hsien (TW)

( * ) Notice: Subject to any disclaimer, the term of this patent is extended or adjusted under 35 U.S.C. 154(b) by 0 days.

(21) Appl. No.: 11/195,471

(22) Filed: Aug. 2, 2005

(65) Prior Publication Data

US 2007/0032309 A1 Feb. 8, 2007

(51) Int. Cl.
*A63B 53/14* (2006.01)

(52) U.S. Cl. ..... 473/301

(58) Field of Classification Search ..... 473/300–303, 473/201–206, 568, 549, 551; D21/756; D08/DIG. 6–8; 74/551.9; 81/489; 16/DIG. 12, DIG. 24, 16/DIG. 18–19, 421, 430
See application file for complete search history.

(56) References Cited

U.S. PATENT DOCUMENTS

| | | | | |
|---|---|---|---|---|
| 3,904,720 | A * | 9/1975 | Sjostrand | 264/45.5 |
| 5,413,339 | A * | 5/1995 | Martin | 473/295 |
| 6,361,450 | B1 * | 3/2002 | Huang | 473/300 |
| 7,189,168 | B2 * | 3/2007 | Lin | 473/300 |
| 7,214,141 | B2 * | 5/2007 | Hung | 473/300 |
| 2002/0107088 | A1 * | 8/2002 | Lamkin et al. | 473/300 |
| 2003/0228930 | A1 * | 12/2003 | Huang | 473/301 |

* cited by examiner

*Primary Examiner*—Stephen Blau
(74) *Attorney, Agent, or Firm*—Charles E. Baxley

(57) ABSTRACT

A handle structure for ball striking equipment includes an underlisting for passing a handle rod of a ball striking equipment through its interior and having a first section and a second section at its exterior, a wrapping strap fixed on the outside of the second section, and the wrapping strap and the first section of the underlisting divide a handle holding section into two gripping sections, and the first section gives a shock absorbing and a slippery resisting effects, and the wrapping strap provides a soft, comfortable and slippery-proof gripping effect.

4 Claims, 6 Drawing Sheets

HANDLE STRUCTURE FOR BALL STRIKING EQUIPMENTS

BACKGROUND OF THE INVENTION

1. Field of the Invention

The present invention relates to a handle for ball striking equipment (such as a golf club), and more particularly to a handle that comes with a gripping mechanism to fit an underlisting for both left-handed and right-handed users.

2. Description of the Related Art

In general, a traditional ball striking equipment such as a tennis racket, a badminton racket, a golf club or a hockey stick comes with a handle wound with a wrapping strap that is made of genuine leather or artificial leather for users to grip. The traditional wrapping strap usually has through holes, pressing patterns, or polished structures, and an elastic member is buried into or added to the wrapping strap to provide the functions of absorbing sweats, resisting slippery and reducing vibrations, so that a user's hands can firmly and comfortably grip the ball striking equipment. Regardless of the design of the wrapping straps, the overall mechanical properties such as the sweat absorbing capability, the coefficient of friction, the elasticity, and the shock resistance are substantially the same, and thus the traditional wrapping strap cannot provide different grips to fit different positions of a user's hand.

As to the sports that require both hands to play, such as gripping a golf club or a tennis racket, the hand that grips the rear end of a club or a racket is the main source of force for striking the ball and thus bearing a vast majority of the reaction from the action of striking balls. The other hand that holds the front end of the club or racket primarily guides the striking direction. In other words, the position of the hand that drives the club or racket should be given better effects of absorbing shocks and resisting slippery, and the position of the other hand that guides the striking direction should be given a more comfortable grip, since both hands have different functions.

SUMMARY OF THE INVENTION

The present invention provides a solution for gripping a ball striking equipment by both hands and a gripping mechanism to fit the requirements of both left-handed and right-handed users.

The technical solution provided by the present invention comprises the following elements:

An underlisting is provided for passing a handle rod of a ball striking equipment inside, and the outside has a first end, a second end, a first section defined by extending a predetermined distance from the first end to the second end, and a second section defined by extending from a terminating end of the first section to the second end, and the overall external diameter of the second section is smaller than the terminating end of the first section, and thus an external diameter difference is occurred at the boundary of the starting end of the second section and the terminating end of the first section.

A wrapping strap is fixed outside the second section.

Therefore, it is a primary objective of the present invention to divide the wrapping strap and the first section of the underlisting into two gripping sections, wherein the first section provides better shock absorbing and slippery resisting effects, and the wrapping strap provides a soft and comfortable slippery resisting effect.

Another objective of the present invention is to provide a first section for the hand that gives the main source of force to strike a ball, and the wrapping strap for the other hand that controls the striking direction, when both hands grip a handle. As a result, the handle can provide different gripping mechanisms for both hands of the user.

A further objective of the present invention is to provide the first section and the section of the wrapping strap for the grip of both hands, so as to create different visual effects for the sports equipment handle.

DETAILED DESCRIPTION OF THE PREFERRED EMBODIMENTS

Figure 1:
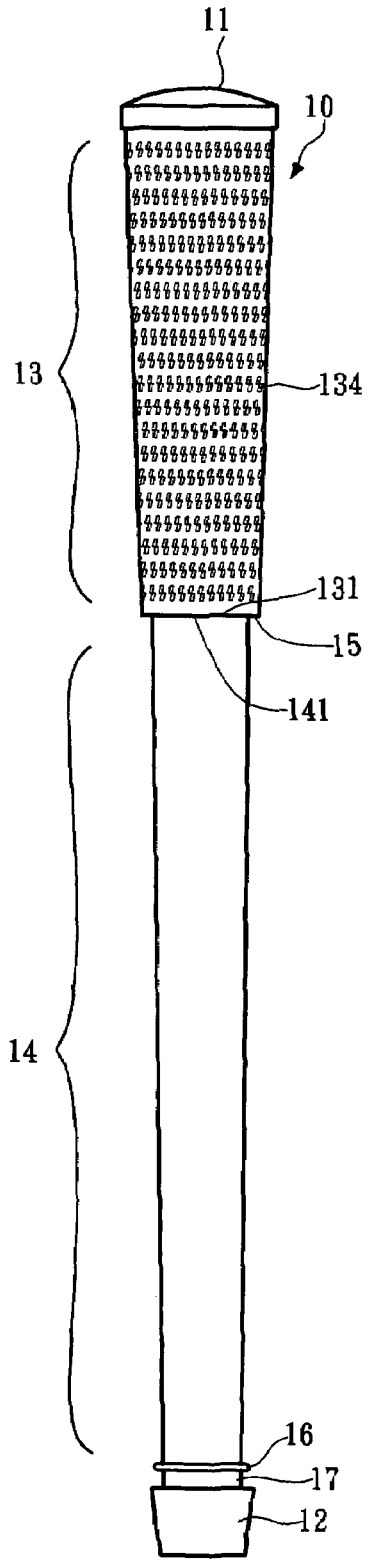
FIG. 1 is a planar view of an underlisting of the invention.

Refer to FIG. 1 for the planar view of an underlisting 10 of the present invention. The underlisting 10 is a soft elastic material, and its interior is capable of accommodating a handle rod of a ball striking equipment such as a golf club, and its exterior has a first end 11, a second end 12 and a conical profile formed between the first and second ends 11, 12. A first section 13 is defined by extending a predetermined distance from the first end 11 along the direction of the conical profile to the second end 12, and a second section 14 is defined by extending from a terminating end 131 of the first section 13 along the direction of the conical profile to the second end 12, and the overall external diameter of the second section 14 is smaller than the terminating end 131 of the first section 13. Therefore, an external diameter difference 15 is occurred at the boundary of the starting end 141 of the second section 14 and the terminating end 131 of the first section 13. Further, a protruded ring 16 is disposed on the second section 14 at a predetermined distance proximate to the second end 12, and a ring groove 17 is formed between the protruded ring 16 and the second end 12.

Figure 2:
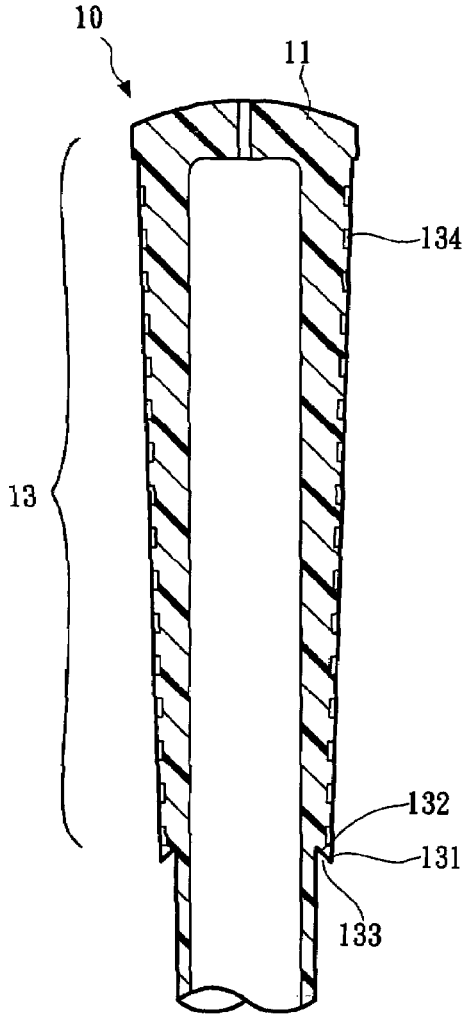
FIG. 2 is a cross-sectional view of a portion of an underlisting of the invention.

Refer to FIG. 2 for the cross-sectional view of a portion of the underlisting 10. In FIG. 2, the external diameter difference 15 is used to form an inwardly inclined surface 132 around the terminating end 131 of the first section 13, such that a circular corner 133 is formed at the boundary of the first section 13 and the second section 14.

Figure 3:
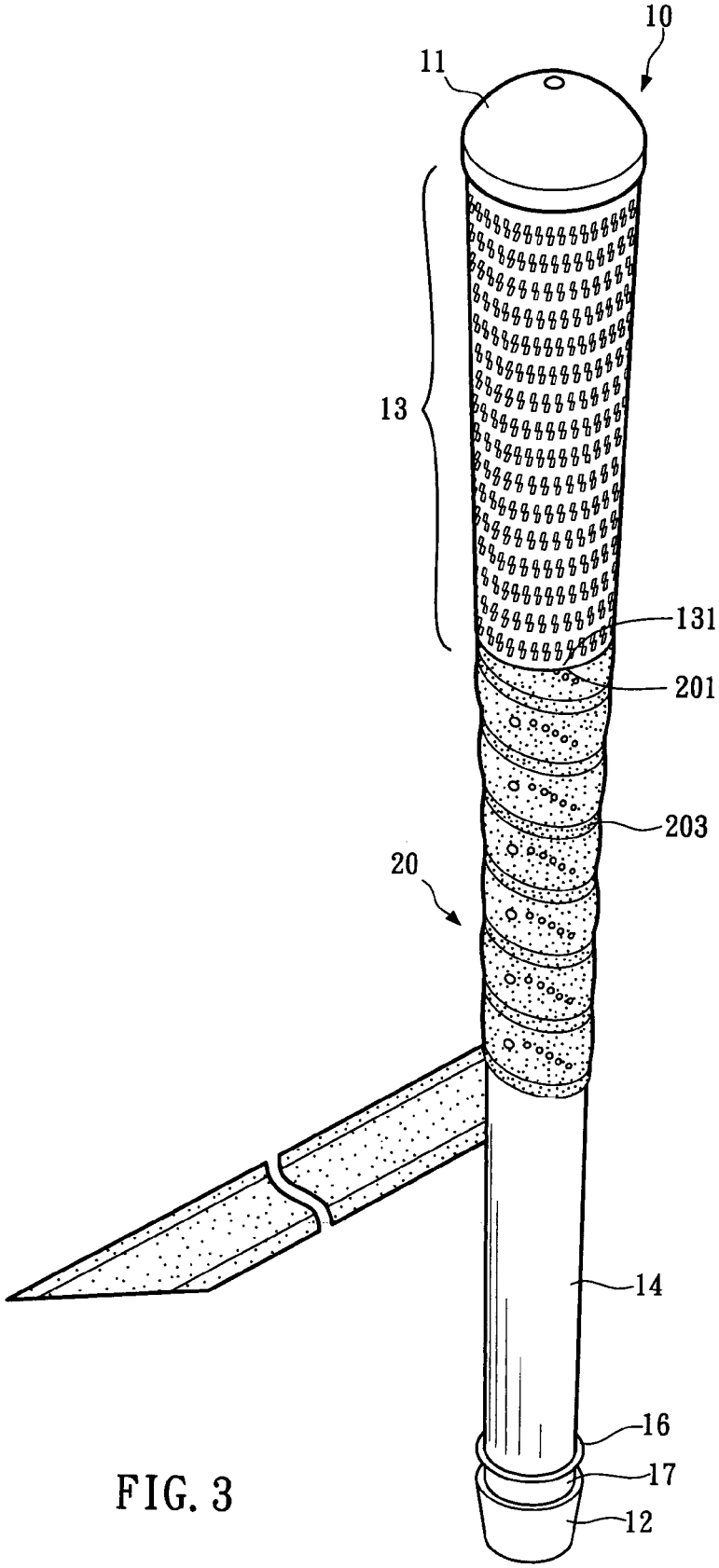
FIG. 3 is a schematic view of an underlisting wound by a genuine leather wrapping strap according to the invention.

Refer to FIG. 3 for the schematic view of the underlisting 10 wound with a wrapping strap 20. Basically, the wrapping strap 20 could be any traditional wrapping strap spirally wound around the second section 14.

Figure 4:
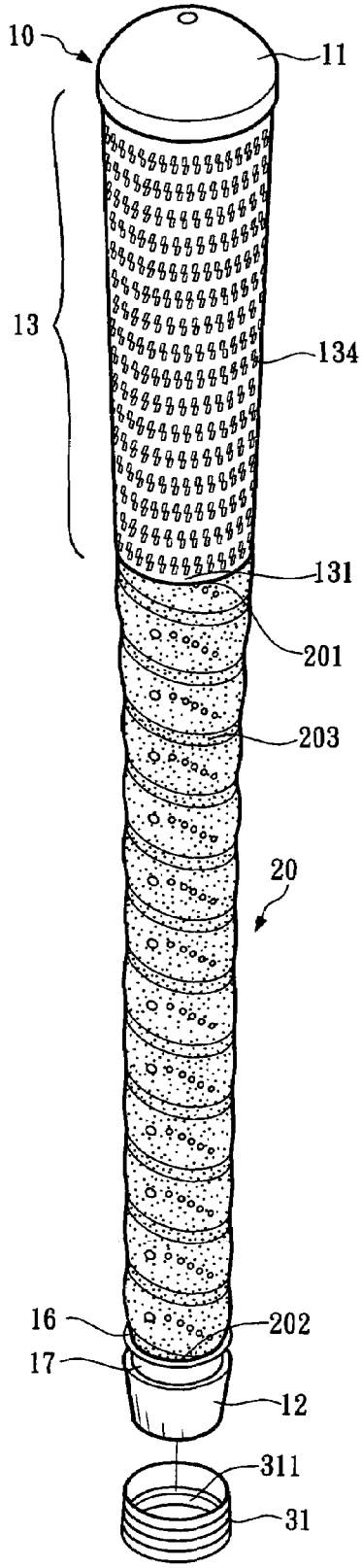
FIG. 4 is a schematic view of an underlisting wound by a genuine leather wrapping strap and two fixing objects used for fixing the starting end and the terminating end of the wrapping strap according to the invention.
Figure 5:
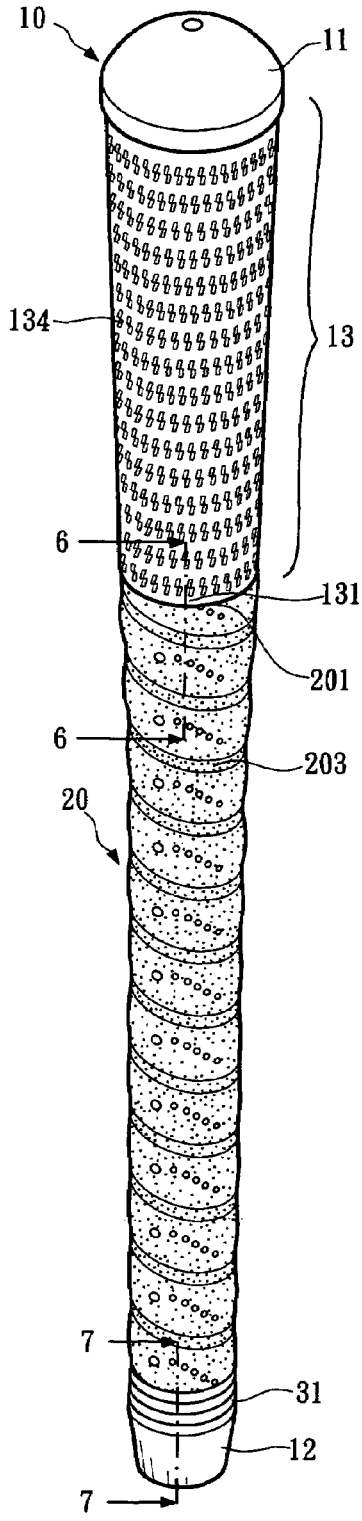
FIG. 5 is a perspective view of an underlisting and a genuine leather wrapping strap forming a ball striking equipment handle according to the invention.
Figure 6:
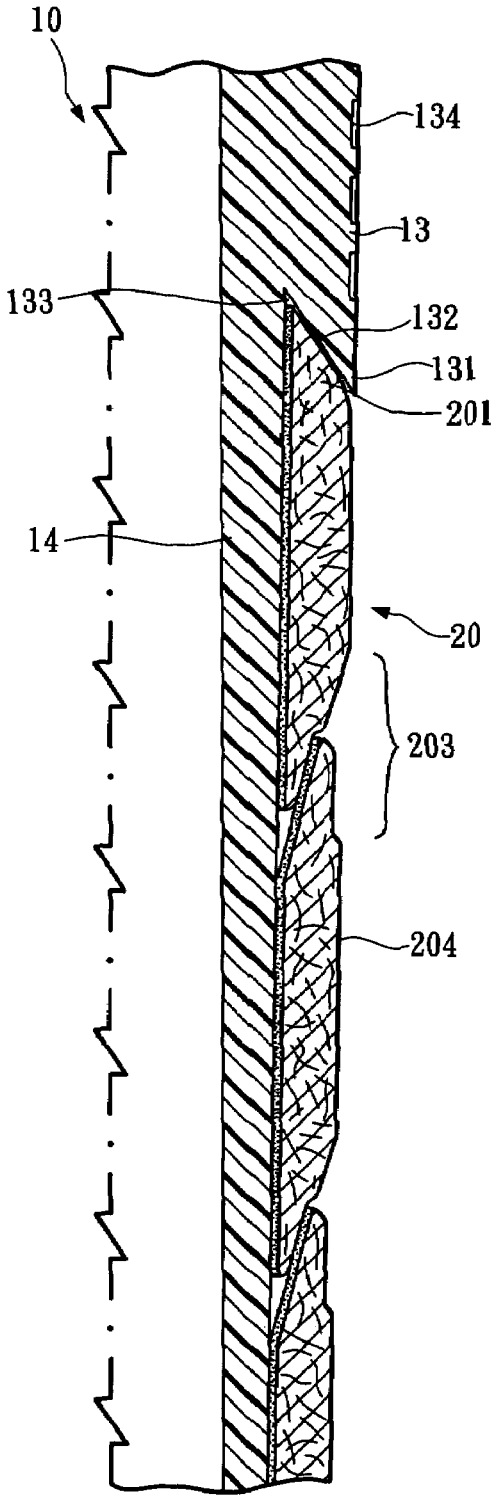
FIG. 6 is a cross-sectional view of Section 6-6 as depicted in FIG. 5.

Referring to FIGS. 4 to 6, a starting end 201 wound with the wrapping strap 20 is extended into the round corner 133 and wound spirally such that the corresponding edges are overlapped with each other, and the overlapped portion 203 is not protruded from an external profile 204 wound by the wrapping strap 20, and the winding at a terminating end 202 is evenly ended at the protruded ring 16. The wrapping strap 20 is fixed onto the terminating end 202 of the winding by a fixing member 31 to prevent the terminating end 202 from becoming loosened.

Figure 7:
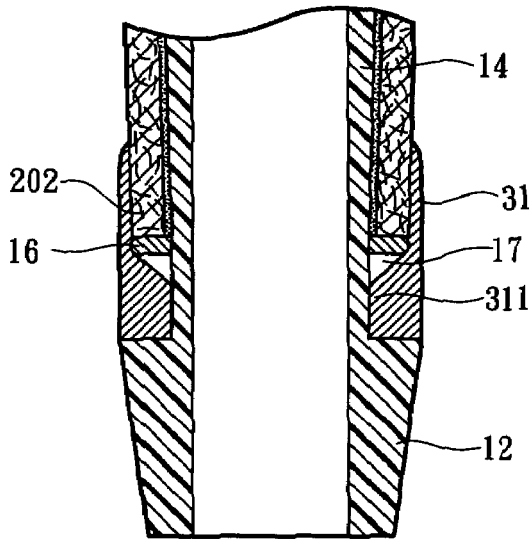
FIG. 7 is a cross-sectional view of Section 7-7 as depicted in FIG. 5.

Refer to FIG. 7, the fixing member 31 at the boundary of the terminating end 202 of the wrapping strap 20 and the protruded ring 16 is an elastic ring with an elastic bidning force, and the fixing member 31 provides a binding force to the terminating end 202 of the wrapping strap 20 and the protruded ring 16. A fixing section 311 protruded from a wall of the fixing member 31 is embedded into the ring groove 17, so that the fixing member 31 can be secured at a predetermined position.

Figure 8:
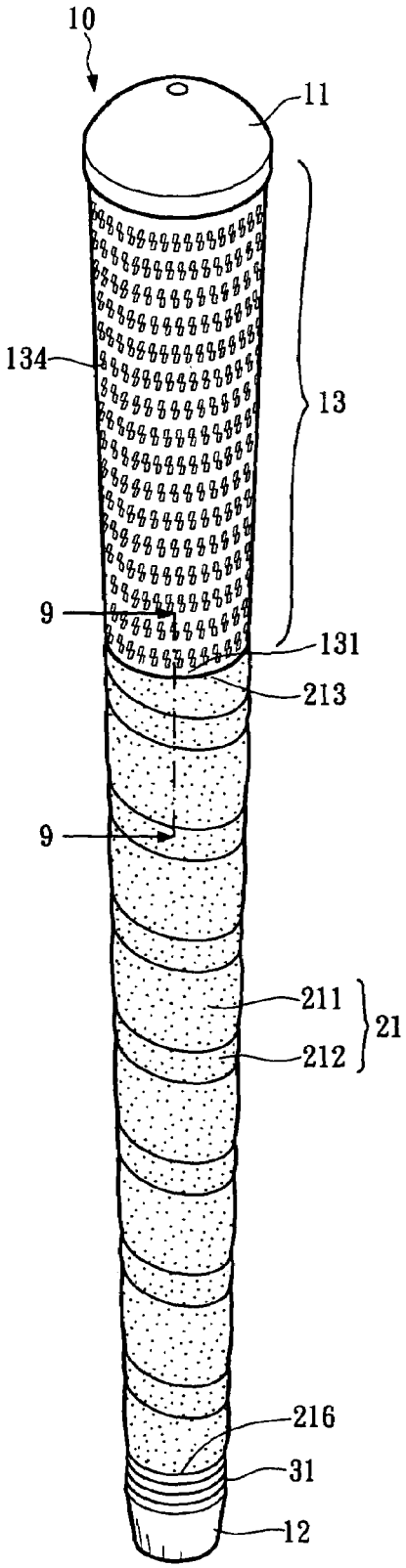
FIG. 8 is a perspective view of an underlisting and another genuine leather wrapping strap forming a ball striking equipment handle according to the invention.
Figure 9:
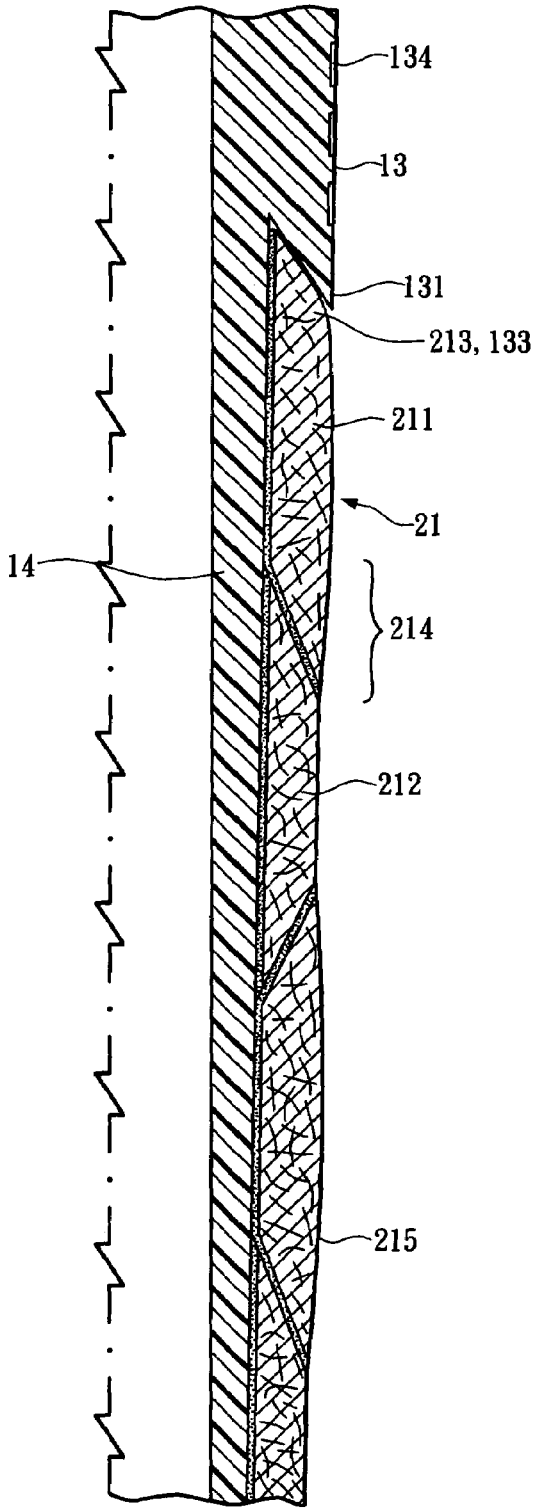
FIG. 9 is a cross-sectional view of Section 9-9 as depicted in FIG. 8.

Refer to FIGS. 8 and 9 for the schematic view of the underlisting 10 being wound by a wrapping strap in another fashion. The wrapping strap 21 comprised of a first and a second strap bodies 211, 212 with different widths spirally wind the second section 14. Similarly to the description above, the starting end 213 of the winding of the wrapping strap 21 is extended into the circular corner 133 and spirally wound, and the corresponding edges are overlapped with each other. The overlapped portion 214 is not protruded from the external profile 215 of the wrapping strap 20. The terminating end 216 is evenly terminated at the protruded ring 16. The wound wrapping strap 21 is fixed at the position of the by a fixing member 216 with a binding force. The wrapping strap 20, 21 as illustrated in FIGS. 1 to 9 is a long bar structure made of genuine leather.

Figure 10:
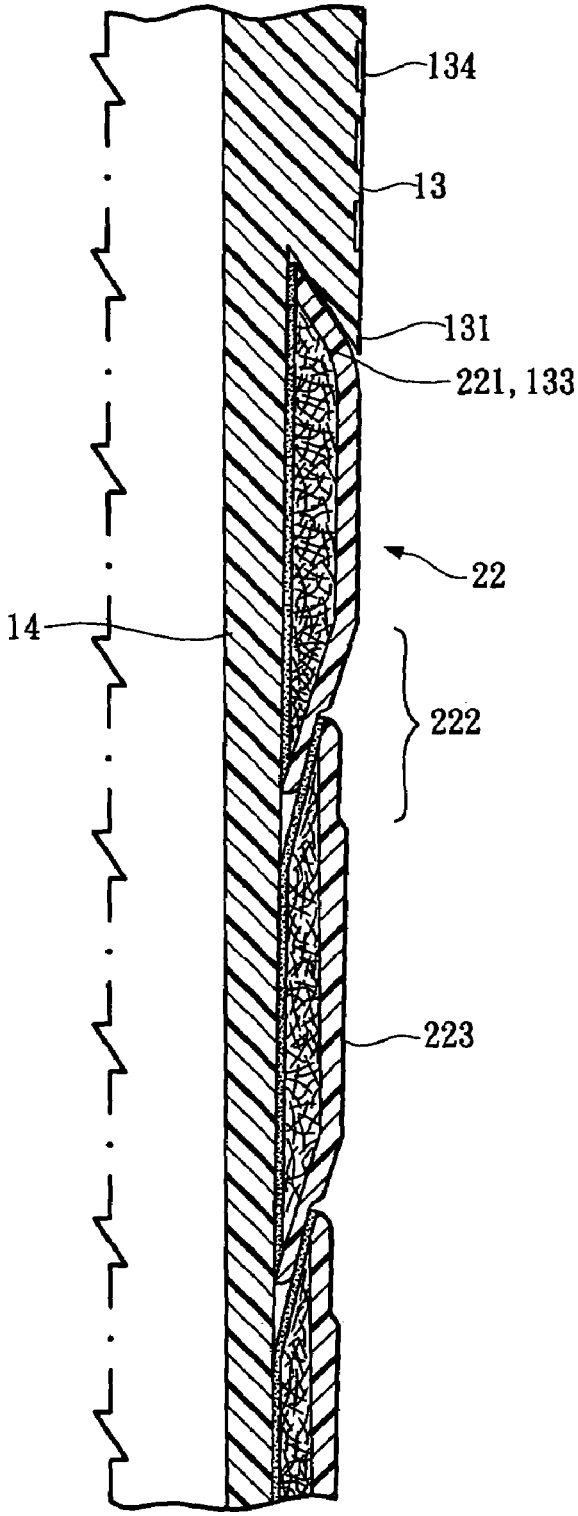
FIG. 10 is a cross-sectional view of a portion of an underlisting and a genuine leather wrapping strap according to the invention.

Refer to FIG. 10 for the cross-sectional view of a section of the underlisting 10 being wound by a wrapping strap in another fashion. In FIG. 10, the wrapping strap 22 is a long bar structure made of artificial leather. Similar to the description above, the starting end 221 of the winding of the wrapping strap 22 is extended into the circular corner 133 and spirally wound, and the corresponding edges are overlapped with each other. The overlapped portion 222 is not protruded from the external profile 223 of the wrapping strap 20.

The foregoing first section 12 and the wrapping strap 20, 21, 22 divide the underlisting 10 into upper and lower gripping sections. The first section 13 has an external profile for an even grip, and the wrapping strap 20, 21, 22 has a wavy external profile. For example, a right-handed golf player uses his/her left hand that gives the main source of striking force to grip the first section 13 and his/her right that controls the striking direction of the ball to grip the wrapping strap 20, 21, 22. Since the wrapping strap 20, 21, 22 has a spiral wavy external profile, therefore it provides a better slippery-resisting effect and a more comfortable grip, and the player's right hand can control the striking direction more stably. The first section 13 uses the thickness and elasticity of its own structure to provide a better shock resistance and reduce the reaction from the striking ball on the left hand. The rubber material of the underlisting 10 and the slippery-proof pattern on the underlisting give more frictions and provide a better slippery resisting effect, so that the player can securely grip the handle and control the force of striking the ball. The handle of the present invention can simultaneously provide a gripping mechanism for both left-handed and right-handed players.

To fit the palm size and the gripping position of different players, and simultaneously provide the gripping mechanism simultaneously for both left-handed and right-handed players, the ratio of the axial lengths of the first section 13 and the second section 14 of the underlisting 10 can be changed.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A handle structure for ball striking equipments, comprising:

an underlisting, having a first end and a second end disposed at the exterior of said underlisting, a first section defined by extending a predetermined distance from said first end to said second end, a second section defined by extending from a terminating end of said first section to said second end, and the overall external diameter of said second section is smaller than said terminating end of said first section, and an external diameter difference is occurred at the boundary of said starting end of said second section and said terminating end of said first section;

a wrapping strap, fixed outside said second section, and a protruding ring disposed at a predetermined distance proximate to said second end, and a ring groove is formed between said protruded ring and said second end wherein said wrapping strap is wound and fixed onto said second section of said underlisting, and said terminating end of said wrapping strap is ended at said protruded ring; and wherein said terminating of said wrapping strap and said protruded ring is fixed at their boundary by a fixing member having a binding force.

2. The handle structure for ball striking equipment of claim 1 wherein said fixing member is an elastic ring having an elastic binding force.

3. The handle structure for ball striking equipment of claim 2, wherein said elastic ring includes a fixing section protruded from its wall and embedded into said ring groove.

4. The handle structure for ball striking equipment of claim 1 wherein said first section of said underlisting includes a slippery-proof pattern disposed on the surface of said first section.

* * * * *